United States Patent [19]

Frank et al.

[11] 4,087,242

[45] May 2, 1978

[54] PRODUCTION OF VARIEGATED POLYESTER YARN AND FABRIC

[75] Inventors: Floyd Frank, Levittown; Aylmer John Woodward, Ambler, both of Pa.

[73] Assignee: Monsanto North Carolina Incorporated, Fayetteville, N.C.

[21] Appl. No.: 663,028

[22] Filed: Mar. 2, 1976

[51] Int. Cl.[2] ..... D06B 11/00; B05D 5/06; D06P 5/22

[52] U.S. Cl. ..... 8/15; 8/DIG. 4; 264/342 R

[58] Field of Search ..... 8/15, DIG. 4; 264/342 R

[56] References Cited

U.S. PATENT DOCUMENTS

| | | | |
|---|---|---|---|
| 1,968,677 | 7/1934 | Ferguson | 8/17 |
| 1,992,259 | 2/1935 | Taylor | 8/5 |
| 3,153,106 | 10/1964 | Schlick | 264/78 |
| 3,366,299 | 1/1968 | Rose et al. | 226/44 |
| 3,589,854 | 6/1971 | Cobb et al. | 8/14 |
| 3,634,580 | 1/1972 | Watase et al. | 264/342 |

OTHER PUBLICATIONS

Precision Machine & Development Co., Yarn Finish Applicator, 1970.

ADR (American Dyestuff Reporter) pp. 11–17, Jan. 31, 1966.

*Primary Examiner*—John Kight, III

*Attorney, Agent, or Firm*—Robert L. Broad, Jr.

[57] ABSTRACT

A polyester yarn is treated, so that it may be dyed in yarn or fabric form to a variegated appearance, by running partially oriented polyester feeder yarn over a surface wetted with a liquid reagent which alters the affinity of the yarn to a disperse dye, followed by drawing or draw-texturing. The surface may be a groove formed across the tip of a capillary tube wherein the groove is wetted by a liquid reagent supplied through the bore of the tube. Intermittent contact between the feeder yarn and the reagent is thereby obtained.

12 Claims, 7 Drawing Figures

PRODUCTION OF VARIEGATED POLYESTER YARN AND FABRIC

BACKGROUND OF THE INVENTION

This invention relates to a process for producing polyester yarn which is capable of being dyed in yarn or fabric form to a variegated appearance, to systems and apparatus for such treatment, and to the resulting dyed or undyed polyester yarn and fabric made therefrom.

The random dyeing of polyester yarn to obtain a variegated appearance, whether of contrasting tones of a single color or of several colors, is a commercially desirable result since the resulting yarns and fabrics exhibit a pleasing appearance in whatever forms the yarns or fabrics may be used. The variegated effect, however, is difficult to achieve by dyeing techniques alone because polyester yarn is notoriously resistant to dyeing. Furthermore, although dye assistants and dye resists are known, it is difficult to pretreat the yarn before dyeing to obtain truly random coloration.

U.S. Pat. No. 3,155,754 to Adams discloses pretreatment of unoriented polyester yarn with certain semisolvents in order to make the yarn more receptive to dyeing. This patent nevertheless does not teach how the dyeing may be randomized.

U.S. Pat. No. 3,906,757 to Arimoto et al. teaches apparatus for the continuous dyeing of polyester yarn utilizing applicators having bore diameters of 0.25 mm., and intermittent dyeing by dyeing only on discrete sides of the yarn or by interrupting the dye flow.

U.S. Pat. No. 3,724,997 to von der Eltz et al. discloses space-dyeing by injection of dyestuffs into bobbins of yarn positioned on a heated conveyor belt. U.S. Pat. No. 3,153,106 to Schlick teaches variegated dyeing of polyester yarn by heat treating the yarn at spaced intervals prior to dyeing. These techniques are either unduly expensive or do not give good color contrast and variegation.

Other patents which suggest techniques and apparatus for pretreatment of yarn before dyeing, but utilizing complicated procedures and devices, are U.S. Pat. Nos. 2,678,024 to Kresse and 3,589,854 to Cobb et al.

While it is generally known that disperse dye receptivity of a polyester yarn may be increased by treatment with certain polyester solvents, as discussed by Lemons et al. in *American Dyestuff Reporter*, Jan. 31, 1966, pages 11–17, or of polyester film, as in U.S. Pat. No. 3,446,886 to Karickhoff, such teachings do not suggest how polyester yarn can be rendered capable of being dyed to provide a variegated appearance, whether the dyeing is effected on the yarn itself or on fabrics made from the yarn. The problem is how to treat polyester yarn so that any of the conventional disperse dyeing techniques can thereafter be used to produce a variegated effect, whether on the yarn itself or on fabrics made from the yarn.

OBJECTS AND SUMMARY

Accordingly, an object of this invention is to provide a process for treatment of polyester yarn prior to disperse dyeing of the yarn such that upon dyeing of the yarn or fabrics made from the yarn, variegated coloration is obtained.

Another object is to provide a process which places polyester yarn or fabrics made therefrom in condition for dyeing to a variegated appearance by any efficient disperse dyeing technique.

Another object is to provide a process for placing polyester yarn in condition for variegated dyeing wherein the character of the variegations may be controlled as desired with respect to the extent of randomization and other character of the coloration, such as frequency and length of the variegations, but nevertheless utilizing a system which is highly efficient and economical.

These and other objects, features and advantages of the invention will become apparent from the description which follows.

In summary, the foregoing and other objects are achieved by a process wherein partially oriented polyester feeder yarn is run over and in contact with a horizontally positioned surface wetted with a liquid reagent capable of altering the affinity of the yarn to a disperse dye, followed by drawing and/or texturing of the yarn. The reagent is supplied to the surface through an orifice which opens generally in the plane of the surface, the orifice having a diameter of from about 0.1 to about 3 mm. Preferably, the surface is smooth and stationary. As a result of this arrangement, intermittent contact is obtained between the feeder yarn and the reagent. In this preferred aspect, the thus-treated yarn is heated to a temperature above the boiling point of the reagent before or during drawing and/or texturing. The treated yarn may be textured in any conventional manner and wound into a suitable package.

The treatment with the liquid reagent physically alters the surface of the yarn so that the portions of the yarn so altered become more receptive to dyeing in variegated patterns with a disperse dye. The technique may be used to obtain a variegated effect either in the yarn itself or in fabrics made from the reagent-treated yarn, upon subsequent dyeing of the yarn or fabrics.

DETAILED DESCRIPTION

Figures 1, 2, 3, 4, 5, 6, 7:
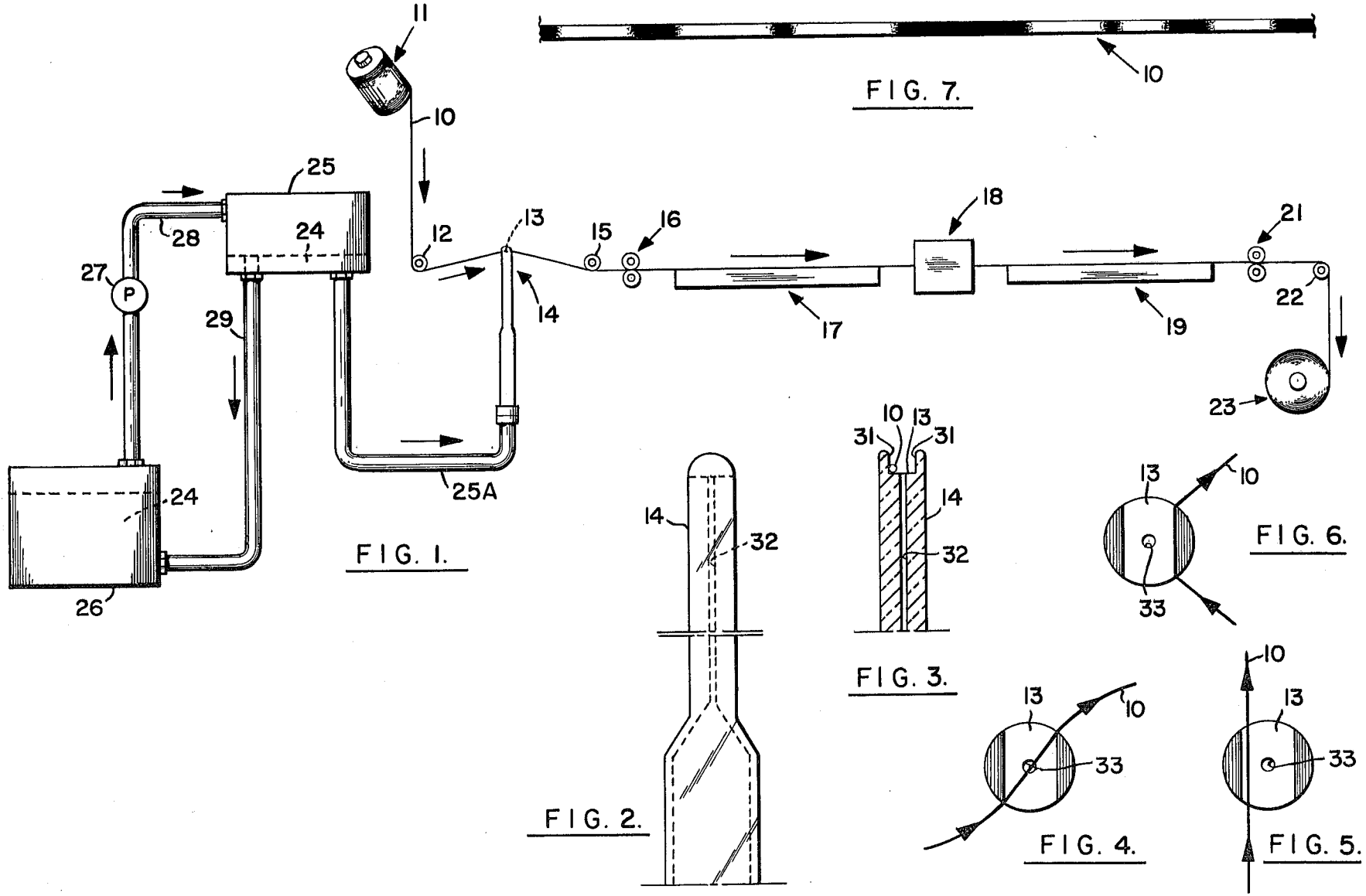
FIG. 1 is a schematic view of one embodiment of the invention.
FIG. 2 is an enlarged, elevational view of the dye applicator 14 shown in FIG. 1.
FIG. 3 is a view of the tip of the applicator 14 of FIG. 2 turned 90°.

FIGS. 4, 5 and 6 are plan views of the top of the applicator 14 shown in FIGS. 2 and 3, showing yarn paths; and FIG. 7 is a plan view of a section of yarn treated in accordance with the invention.

With reference to FIG. 1, partially oriented polyester yarn 10 is fed from a suitable package 11 such as a parallel tube or cone over a guide roller 12 into contact with the reagent-wetted surface 13 at the tip of a tubular applicator 14. The entry and exit angles of the yarn over applicator 14 generally are 90° or less so that contact between the yarn and surface 13 is assured.

The yarn then passes over another guide such as guide roller 15 and is run through nip draw rolls 16 over a first heater 17 to a texturing device 18. The yarn may be drawn and/or textured in any manner known in the art such as spindle twisting, friction twisting, stuffer box texturing, knife edge crimping, or the like. A second heater 19 optionally may follow the texturing treatments in order to heat-set the crimp obtained in the texturing step, in a manner well-known in the art. The yarn then passes through a second pair of nip draw rolls 21 to draw the yarn to the desired denier. After passing over another guide such as a guide roller 22, the yarn is wound into a package 23. In place of contact heaters 17 and 19, heating zones of any suitable design may be used.

Liquid reagent 24 is supplied to surface 13 in any suitable manner, such as essentially gravity flow from a tank 25 through a tubular connector 25a. The reagent may be supplied to tank 25 from a reservoir 26 via a pump 27 in a line 28. Reagent level in tank 25 is maintained by continuous circulation from reservoir 26 and an overflow line 29.

A convenient form of reagent applicator providing a generally horizontal surface 13 is a glass or metal capillary tube 14, shown in detail in FIGS. 2 and 3, mounted in a generally vertical position. The surface 13 may be formed as a groove in the tip of the capillary tube 14, the walls 31 of the groove forming a guide for the yarn 14 over the surface 13. The surface 13 may be flat or curved but should be smooth so that it can be adequately wetted with the reagent and provide minimal frictional resistance to running of the yarn thereover. The bore 32 of the tube normally has its orifice 33 centrally positioned in the plane of the surface 13 but the orifice may be positioned off-center, if desired.

As shown in FIGS. 4, 5 and 6, the yarn 10 may run in a path off-set from orifice 33 but in essentially a straight line across the surface 13 (FIG. 5), or it may run in an S-shaped path across the surface 13 (FIG. 4), in which case it will pass over the orifice 33. The yarn 10 may also run over the surface 13 in a semi-circular path off-set from orifice 33, as shown in FIG. 6. The preferred path is that of FIG. 5 in that it has been found that randomization of contact between the yarn and the reagent is greatest when the yarn has some freedom of lateral movement over surface 13.

In any configuration or position of reagent-wetted surface 13, the surface should be stationary and generally horizontal so that it can be wetted and then wiped by the yarn while the reagent is fed to the surface under essentially gravity flow or under a slight positive pressure. Too rapid flow of the reagent to the surface 13 will cause the reagent to collect in too large a volume on the surface 13, thereby preventing the intermittent contact between the yarn and reagent required to obtain the variegated coloration upon subsequent dyeing of the yarn or fabrics made therefrom.

The polyester feeder yarn is yarn commonly known in the art as "partially oriented" yarn. This is yarn in its condition after extrusion and before it has been fully drawn, that is, drawn to the maximum length of which it is capable. Accordingly, "partially oriented" in this specification means undrawn or less than fully drawn yarn, and more preferably refers to yarn which has not yet been draw-textured. It is understood that, normally, yarn can never be totally undrawn since the operation of the winding up a yarn as it exits from an extruder, or the running of extruded yarn to another station, in itself will draw the yarn somewhat.

Polyester feeder yarns useful in the process in the invention may also be described in terms of their stress/strain curves (ASTM D2256). Generally, those polyester feeder yarns are useful wherein the degree of orientation is such that the yarn will exhibit no more than a 10% load increase (tenacity in grams per denier) with a 10% increase in elongation at some point on the standard stress/strain curve for the yarn. Generally, the less drawn the feeder yarn, the longer will be the flat portion along the stress/strain curve and the greater will be the depth of variegated coloration. Therefore, relatively undrawn feeder yarns are preferred.

In terms of currently availabe polyester yarns, suitable yarns are those which have residual drawability to a ratio of about 1.5 to 4.0, preferably to a ratio of about 1.7 to about 2.4. When the texturing is a drawtwist texturing device, the total denier of the feeder yarn for presently available devices will be about 40–300, preferably about 100–200. However, the process of the invention is readily adaptable to any feeder yarn deniers and texturing systems. Likewise, the number of filaments in the feeder yarn and denier per filament are not critical.

The running speed of the yarn at the point of contact between the yarn and the surface 13 wetted with the reagent 24 is not critical. For economy it normally will be at least about 50 meters per minute, preferably at least 80 meters per minute. The maximum running speed is dependent only upon wind-up machine capabilities; therefore the speeds may exceed 1,000 meters per minute.

The intermittent treatment of the yarn with the reagent is relatively insensitive to reagent flow rate, the flow rate course depending upon reagent viscosity, the geometry of the wetted surface 13 and the path of the yarn over the surface. A reagent flow of about 10–20 cc. per hour is effective for a yarn contact surface of the form shown in FIG. 3 for preferred reagents.

It has been observed that the distance between orifice 31 and the yarn path on surface 13 determines the variation in length and frequency of the treated sections on the yarn and therefore the randomness of the variegations. When the yarn is constrained to run directly over the orifice or in a path which includes the orifice, the treated sections are longer and less random. When the yarn path does not include the orifice, the treated sections are shorter and more frequent and randomness is increased. In either event, the intermittent contact between the reagent and the yarn is surprising and unexpected since the same or similar applicator devices are known for continuous delivery of a lubricant, dye or other reagent to yarns running over the applicators. While the effect is not fully understood, high speed motion picture studies seem to show that the yarn wipes the wetted surface to an intermittent and essentially dry state before the surface is again wetted by the reagent. This alternating dry and wet character of the surface causes the intermittent pick-up of reagent and ultimately the variegated effect upon dyeing of the yarn or fabrics made therefrom.

Reagents useful in the invention are any solvents, semi-solvents or swelling agents for polyester which will not cause a loss in tensile strength of the polyester of more than 40% as a result of the intermittent contact with the reagent. A wide range of reagents are therefore useful for the purposes of the invention, including various mixtures of solvents. For the purposes of this specification, "semi-solvent" is considered equivalent with "solvent" so long as the reagent does not degrade polyester beyond the extent indicated. The useful solvents are organic compounds which are liquids under normal conditions or which are soluble in other solvents. The reagents therefore include a wide variety of hydrocarbons (both aliphatic and aromatic), substituted hydrocarbons, such as halogenated hydrocarbons and nitro alkanes, hydroxy compounds, ethers, alcohol ethers, ketones, aldehydes, acids, acid anhydrides, esters, nitriles, phosphates, amines, glycol ethers, and heterocyclic compounds.

Table I below sets forth a variety of such reagents in ten classes. Generally, the reagents which are useful per se are those of Classes 3 through 7. However, those which per se provide little or no variegation (Classes 1 and 2) or which unduly degrade the yarn at least upon prolonged contact (Classes 8–10), can be used by dilution with either a stronger solvent or a weaker solvent, as the case may be. For example, although dioxane falls into Class 10, it can be made useful by dilution with ethanol to form a 75/25 dioxane/ethanol mixture or by dilution with water to form a 75/25 dioxane/water mixture. Other preferred reagent mixtures are 5–30% of ethylene dichloride, methylene dichloride, trichlorobenzene, dioxane or acetone in 1,1,1-trichloroethane, and 10–50% methylene dichloride in perchloroethylene. Many other reagents and mixtures thereof can be used as set forth in U.S. Pat. No. 3,155,754 to Adams.

TABLE I

Class 1 carbon tetrachloride
ethanol
isopropanol
heptane
triethylamine
ethylene glycol
polyethylene glycol
decahydronaphthalene
cyclohexane Class 2 perchloroethylene
1,1,1,trichloroethane
piperidine
tetramethylsilane

Class 3 acetone
xylene

Class 4 toluene
acetic acid
acetic anhydride
acrylonitrile
acetaldehyde
triethyl phosphate
acetonitrile
tetrahydrofurfuryl alcohol Class 5 benzene
ethyl acetate
chlorobenzene
phenyl ether
2-nitropropane
ethylacetoacetate
dimethylmalonate Class 6 o-dichlorobenzene
trifluoroethanol

Class 7 methyl salicylate
1-bromonaphthalene

Class 8

2,4-pentanedione ethylene chloride
methyl benzoate
benzyl chloride
dimethyl sulfoxide
benzyl alcohol
sulfolane
diethylene glycol dimethylether
cyclohexanone
methylene chloride
epichlorohydrin
N,N-dimethylaniline Class 9 pyridine
tetrahydrofuran
dimethylformamide
dimethylacetamide
benzaldehyde
1,2-dibromoethane
nitrobenzene Class 10 dioxane
tetrachloroethane
m-cresol
aniline
chloroform
1,1,2-trichloroethane

In a preferred aspect of the invention, the yarn after treatment with the reagents is heated to a temperature above the boiling point of the reagents but below the melting point of the yarn, for example, from about 60° to about 230° C. The heating appears to enhance the color contrast when the treated yarn is subsequently dyed. The first heater of a conventional draw-texturing system may be utilized as the heater or, if the draw-texturing system is remote from the reagent applicator, an auxiliary heater may be used. Best results are obtained when the heater is within about 2–20 inches from the point of contact between the reagent and the yarn, a preferred distance being about 12–18 inches. However, this depends upon running speed, the faster the speed the more distant the heater may be from the solvent application point. For example, yarn run at about 240 meters per minute will permit use of a heater placed about 36 inches from the solvent-yarn contact point.

The dyes used to dye the polyester yarn or fabric treated in accordance with the invention are any of the disperse dyestuffs known for use on polyester. These include water-insoluble azo, anthraquinone, and phthalocyanine dyestuffs, such as disclosed in U.S. Pat. No. 3,724,997 to von der Eltz et al., and many others known in the art. The result is a variegated yarn such as shown in FIG. 7 wherein the portions of the yarn pretreated with a liquid reagent of the invention are more darkly colored than the untreated portions. Due to the relatively long contact time required for dyeing with disperse dyes, the yarn is normally dyed in package, skein or fabric form. When single-knit or double-knit fabrics are formed from the yarn after dyeing, the variegations are evident as Shantung-like striations in the fabric. In woven fabrics, the striations form attractive criss-cross patterns.

Following are examples illustrating the process of the invention. However, in view of the foregoing description it will be recognized that many variations are possible on the conditions set forth in these examples and come within the scope of the invention, as indicated in the appended claims. All percentages or parts are by weight.

EXAMPLE 1

In apparatus essentially as shown in FIG. 1, partially oriented polyester yarn, 255 denier, is run in a path about 0.036 inches from the orifice of a ¼ inch (O.D.) glass capillary having a 0.5 mm. bore. The running speed is about 80 mm. per minute. A 90/10 mixture of 1,1,1-trichloroethane/methylene dichloride is maintained in the capillary at a flow rate of about 16 cc./hr. A heater, such as heater 17 in FIG. 1, is positioned within about 14 inches of the point of contact between the yarn and the solvent mixture flowing from the capillary onto surface 13. It is noted that pick-up of the solvent mixture by the yarn is intermittent. The thus-treated yarn is then passed through a draw-twist texturing device and then over a second heater through draw rolls to a wind-up station to obtain a 150 denier yarn. The first heater is maintained at a temperature of about 200° C. and the second heater also at about 200° C. Upon subsequent dyeing of the yarn with a disperse dye, random striations of color are obtained along the length of the yarn, the striations varying in length of from about ¼ inch to about 4 inches and averaging about 2 inches in length.

EXAMPLE 2

Essentially as described in Example 1, a solution of 1% Disperse Red 60 in a 90/10 mixture of 1,1,1-trichloroethane/methylene dichloride was applied to the polyester yarn. The resulting variegations were red striations on a white to pink background and were found to be fast to washing and dry-cleaning. This example illustrates the feasibility of obtaining the variegations in one step which combines reagent treatment and dyeing.

EXAMPLE 3

Example 1 is repeated in all essential respects except that the liquid reagent was a 60/40 mixture of perchloroethylene and methylene chloride. The yarn was subsequently knitted into a sleeve on a Lawson Fiber analysis knitter. When the sleeve was dyed with a disperse dye, random striations of color were obtained throughout the fabric.

EXAMPLE 4

Example 1 was repeated in all essential respects except that the point of contact between reagent and yarn was 48 inches from the first heater of the draw texturing equipment. A 6-inch shoe heater at 75° C. was placed in contact with the treated yarn 12 inches from the applicator. The yarn so produced was dyed with a disperse dye. The resulting variegations were substantially identical to those produced in Example 1.

We claim:

1. A process for producing polyester yarn, capable of being dyed in yarn or fabric form to a variegated appearance, said process comprising running partially oriented polyester feeder yarn with freedom of lateral movement over and in contact with a smooth, stationary, horizontally positioned surface wetted with a liquid reagent capable of altering the affinity of the yarn to a disperse dye, said liquid reagent being supplied to said surface through an orifice in said surface, said orifice having a diameter of from about 0.1 to about 3 mm., the yarn running speed and the reagent flow rate being adjusted to prevent continued contact between yarn and reagent, whereby the yarn wipes the wetted surface to an intermittent and essentially dry state before the surface is again wetted by the reagent and random contact between said feeder yarn and said reagent is obtained, and thereafter drawing or draw-texturing yarn.

2. A process as in claim 1 wherein the degree of orientation of said feeder yarn is such that said feeder yarn will exhibit no more than a 10% load increase with a 10% increase in elongation at some point on the stress/-strain curve for said yarn.

3. A process as in claim 2 wherein said feeder yarn is drawn to a draw ratio of about 1.5 to about 4.0.

4. A process as in claim 1 wherein said reagent is a polyester solvent which will cause a loss in tensile strength of no more than 40% in said feeder yarn as a result of said intermittent contact.

5. A process as in claim 4 wherein said reagent is selected from ethylene dichloride, methylene dichloride, trichlorobenzene, dioxane, acetone, perchloroethylene, 1,1,1-trichloroethane and any mixtures thereof.

6. A process as in claim 5 wherein said mixtures comprise the following:

50–90% perchloroethylene and the balance being methylene dichloride;

70–95% 1,1,1-trichloroethane and the balance being ethylene dichloride, methylene dichloride, trichlorobenzene, dioxane or acetone.

7. A process as in claim 1 wherein the path in which said feeder yarn runs over said surface includes said orifice.

8. A process as in claim 1 wherein the path in which said feeder yarn runs over said surface excludes said orifice.

9. A process as in claim 1 wherein said path defines an S-shaped curve over said surface.

10. A process as in claim 1 wherein said surface is defined by a groove in the tip of a capillary tube, and said orifice is defined by the bore of said tube.

11. A process as in claim 1 wherein the running speed of said polyester yarn is at least about 50 mm./min. and said yarn is heated above the boiling point of said reagent but below the melting point of said yarn after contact with said reagent and before said draw-texturing.

12. A process as in claim 11 wherein said yarn is heated about 2 to about 20 inches from the point of contact between said reagent and said yarn.

* * * * *